US007632107B2

(12) United States Patent
Mizumura

(10) Patent No.: US 7,632,107 B2
(45) Date of Patent: Dec. 15, 2009

(54) BOARD-TO-BOARD CONNECTOR

(75) Inventor: Akinori Mizumura, Yokohama (JP)

(73) Assignee: Molex Incorporated, Lisle, IL (US)

( * ) Notice: Subject to any disclaimer, the term of this patent is extended or adjusted under 35 U.S.C. 154(b) by 0 days.

(21) Appl. No.: 11/792,277

(22) PCT Filed: Dec. 5, 2005

(86) PCT No.: PCT/US2005/043776

§ 371 (c)(1),
(2), (4) Date: Apr. 28, 2008

(87) PCT Pub. No.: WO2006/060726

PCT Pub. Date: Jun. 8, 2006

(65) Prior Publication Data

US 2008/0261462 A1 Oct. 23, 2008

(30) Foreign Application Priority Data

Dec. 3, 2004 (JP) ..... 2004-350842

(51) Int. Cl.
*H01R 12/00* (2006.01)

(52) U.S. Cl. ..... 439/74; 439/83; 439/108

(58) Field of Classification Search ..... 439/74, 439/83, 108

See application file for complete search history.

(56) References Cited

U.S. PATENT DOCUMENTS 4,010,077 A * 3/1977 Pardos ..... 435/309.3
5,697,799 A 12/1997 Consoli et al.
5,836,773 A 11/1998 McHugh et al.
5,873,742 A 2/1999 McHugh (Continued)

FOREIGN PATENT DOCUMENTS

CN 2422740 7/2001

(Continued)

*Primary Examiner*—Gary F. Paumen
(74) *Attorney, Agent, or Firm*—Timothy M. Morella

(57) ABSTRACT

A connector mountable to a printed circuit board is disclosed including a nonconductive housing with a plurality of slots, each slot having an opposed first and second end walls with grooves in each end wall and a plurality of terminals (41). Each terminal has a longitudinal axis, a retaining base (42), a solder portion (44), a resilient contact arm (43) and an alignment tab (45). The retaining base (42) has opposed edges with each edge fitting into a respective groove in the end walls holding each terminal to the non-conductive housing. The solder portion (44) extends from the retaining base (42) adjacent to the first end wall of the slot for soldering to the printed circuit board. The resilient contact arm (43) has opposed first and second sides extending from the retaining base (42), the first side of the arm is located adjacent the second end wall of the slot. The contact arm (43) is adapted to engage with a terminal (21) from a mating connector. The resilient contact arm and the solder portion (44) are offset from each other in a direction parallel to the longitudinal axis of the terminal. A locating tab (45) is stamped from the retaining base (42) with one end adjacent the second side of the resilient contact arm so that the second side of the resilient contact arm will engage the one edge of the locating tab if a side force is placed on the resilient contact arm (43) causing it to move away from the first side wall of the slot.

7 Claims, 8 Drawing Sheets

U.S. PATENT DOCUMENTS

| | | | | |
|---|---|---|---|---|
| 5,915,976 | A * | 6/1999 | McHugh | 439/74 |
| 6,048,213 | A | 4/2000 | Lai et al. | |
| 6,132,258 | A | 10/2000 | Kajinuma | |
| 6,203,365 | B1 | 3/2001 | Wu | |
| 6,250,935 | B1 * | 6/2001 | Mochizuki et al. | 439/74 |
| 6,533,614 | B1 * | 3/2003 | Akama et al. | 439/608 |
| 6,811,411 | B1 | 11/2004 | Hirata et al. | |
| 6,926,539 | B2 * | 8/2005 | Zaderej et al. | 439/74 |
| 7,070,424 | B2 * | 7/2006 | Obikane et al. | 439/74 |
| 2002/0177334 | A1 * | 11/2002 | Akama et al. | 439/74 |
| 2004/0063344 | A1 | 4/2004 | Shin | |
| 2005/0026466 | A1 * | 2/2005 | Kubo | 439/74 |
| 2005/0101163 | A1 * | 5/2005 | Obikane et al. | 439/74 |
| 2006/0019517 | A1 * | 1/2006 | Raistrick et al. | 439/108 |
| 2008/0032524 | A1 * | 2/2008 | Lemke et al. | 439/78 |

FOREIGN PATENT DOCUMENTS

| | | | |
|---|---|---|---|
| EP | 0 829 930 | A2 | 3/1998 |
| JP | H10-125420 | | 5/1998 |
| WO | WO 2004/042874 | A1 | 5/2004 |

* cited by examiner

FIG. 10
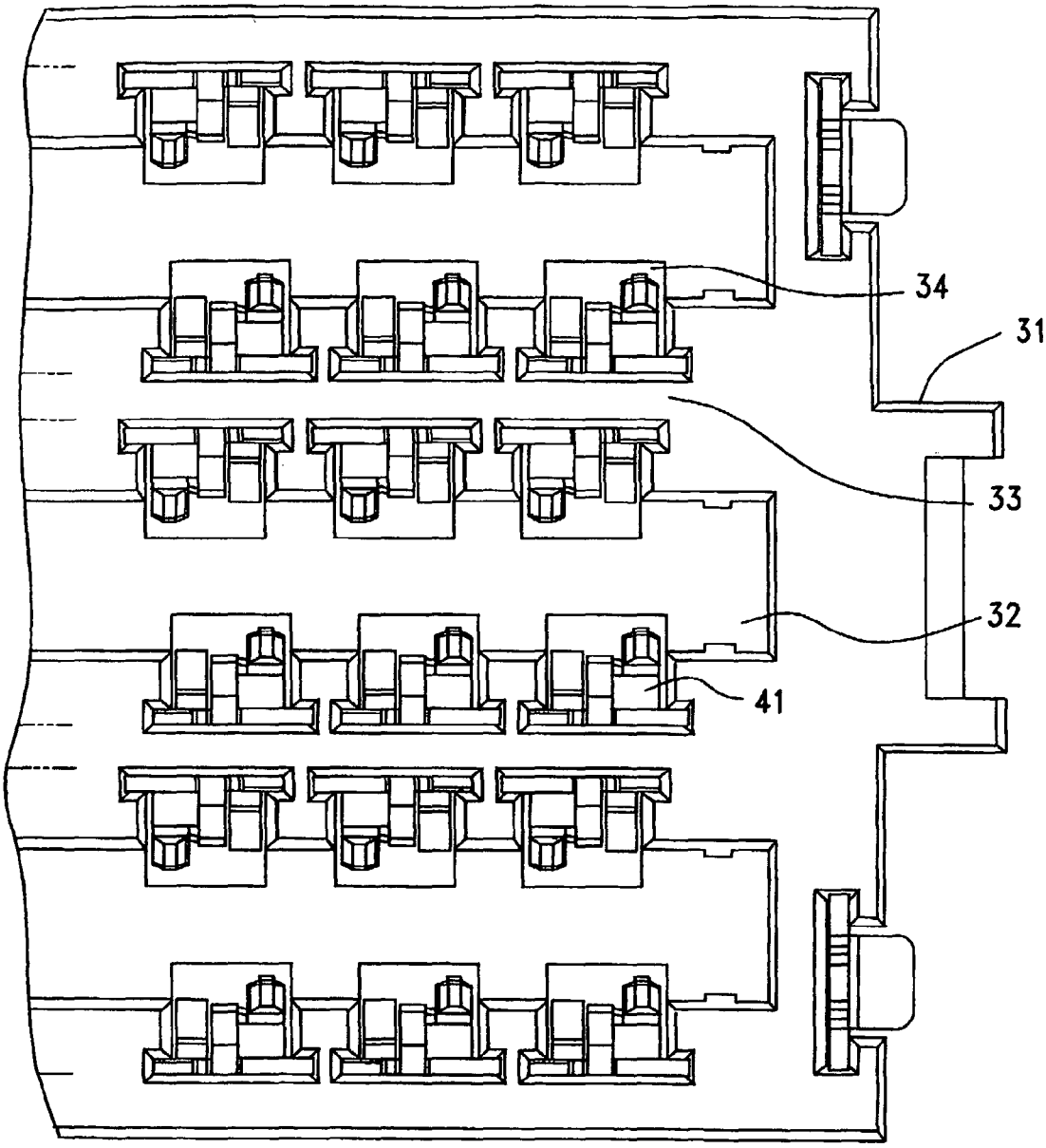
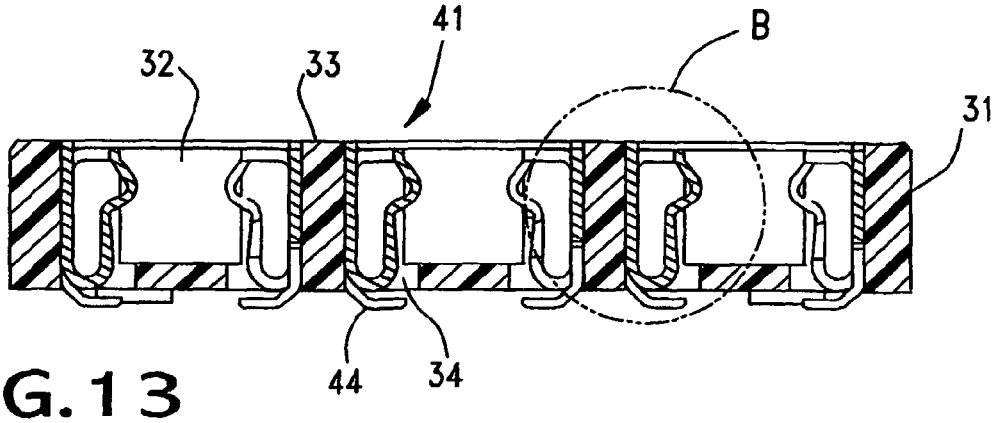
FIG. 13

BOARD-TO-BOARD CONNECTOR

FIELD OF THE INVENTION

The present invention relates to a board-to-board connector.

DESCRIPTION OF THE RELATED ART

Conventionally, a board-to-board connector is used to electrically connect two parallel circuit boards together (see, for example, Japanese Patent Application Laid-Open (kokai) No. H10-125420). Such a board-to-board connector includes two connector sections which are respectively attached to mutually facing surfaces of two circuit boards and projects therefrom. The two connector sections are mated and connected with each other so as to establish electrical connection between the two circuit boards. In this case, each of the connector sections has a plurality of terminals whose tail portions are connected, through soldering, to wiring traces formed on the surface of the corresponding circuit board. When the connector sections are mated together, the terminals of one connector section come into contact with the corresponding terminals of the other connector section, whereby the two circuit boards are electrically connected to each other.

However, the above-mentioned conventional board-to-board connector encounters difficulty in sufficiently reducing the size and mounting area on a circuit board. In recent years, with advancement of miniaturization and densification of electronic apparatuses, a larger number of electronic components are mounted on a circuit board, so that area for mounting a connector is limited. In addition, the number and density of wiring traces formed on a circuit board increases, and therefore, when two circuit boards are connected together, a large number of wiring traces on one circuit board must be connected to a large number of wiring traces on the other circuit board. Therefore, a connector is required to have a large number of terminals, reduced size, and a reduced mounting area. However, the conventional board-to-board connector cannot sufficiently meet these requirements.

SUMMARY OF THE INVENTION

An object of the present invention is to solve the above-mentioned problems in the conventional board-to-board connector and to provide a board-to-board connector which includes a plurality of pairs of rows of terminals which are disposed in an integrally formed single housing and each of which has a surface-mount-type solder tail portion such that the solder tail portion does not project to the outside of the housing, which has a large number of terminals, reduced size, and a reduced mounting area, which is be easily manufactured and mounted to a board, and which has high reliability.

To achieve the above object, a board-to-board connector according to the present invention comprises an integrally formed housing, and a plurality of terminals attached to the housing and forming a plurality of pairs of terminal rows, each terminal having a surface-mount-type solder tail portion, wherein the solder tail portion does not project to the outside of the housing.

Preferably, each of the terminals has a contact portion which comes into contact with a counterpart terminal, and a barrier portion formed between the solder tail portion and the contact portion and formed of a film to which solder hardly adheres.

Preferably, at least some of the terminals have a lean-preventing portion formed on at least one side of the contact portion to be located near the contact portion.

Preferably, the terminals are generally arranged in a grid pattern, and at least terminals located at the outermost positions in the grid pattern are electrically grounded to a board.

Preferably, the terminals are generally arranged in a grid pattern, a signal trace is connected to at least one terminal, and terminals located at positions surrounding the one terminal are electrically grounded to the board.

The board-to-board connector according to the present invention comprises an integrally formed housing, and a plurality of terminals attached to the housing and forming a plurality of pairs of terminal rows, each terminal having a surface-mount-type solder tail portion, wherein the solder tail portion does not project to the outside of the housing. Therefore, the board-to-board connector according to the present invention can have a large number of terminals and reduce size, reduce the mounting area, facilitate manufacture and mounting to a board, and enhance reliability.

BRIEF DESCRIPTION OF THE DRAWINGS

FIG. 10 is an enlarged plan view showing the main portion of the second connector according to the embodiment;

FIG. 13 is a lateral cross-sectional view of the second connector according to the embodiment;

DESCRIPTION OF THE PREFERRED EMBODIMENT

An embodiment of the present invention will next be described in detail with reference to the drawings.

Figure 1:
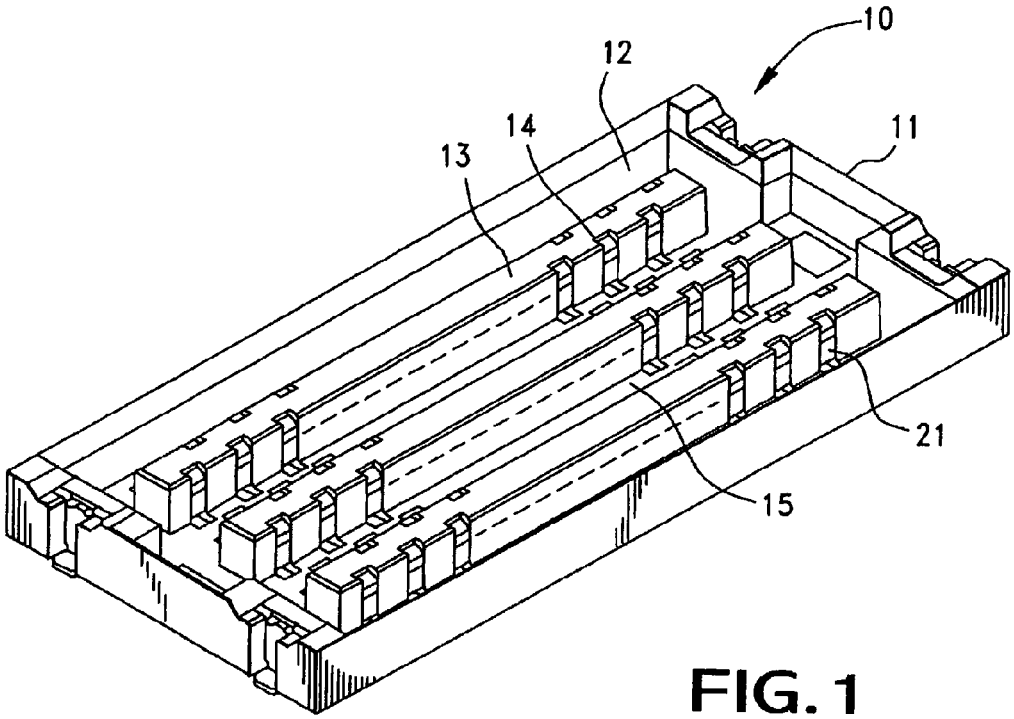
FIG. 1 is a perspective view of a first connector according to an embodiment of the present invention.
Figure 2:
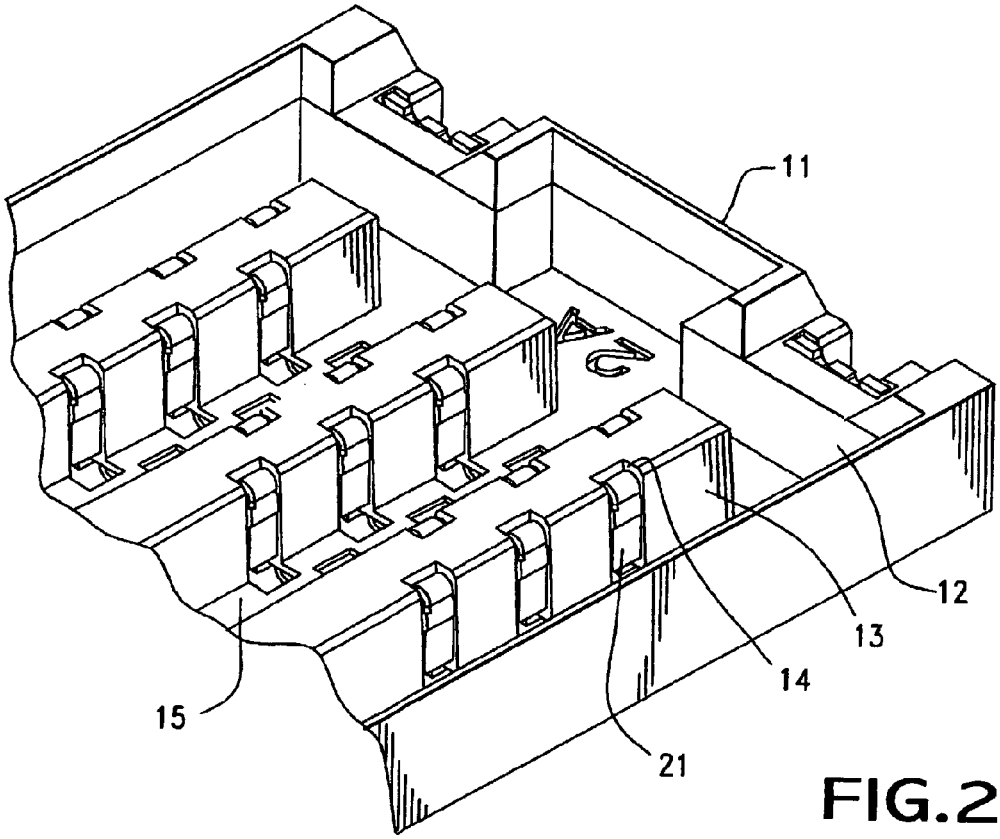
FIG. 2 is an enlarged perspective view showing a main portion of the first connector according to the embodiment.
Figure 3:
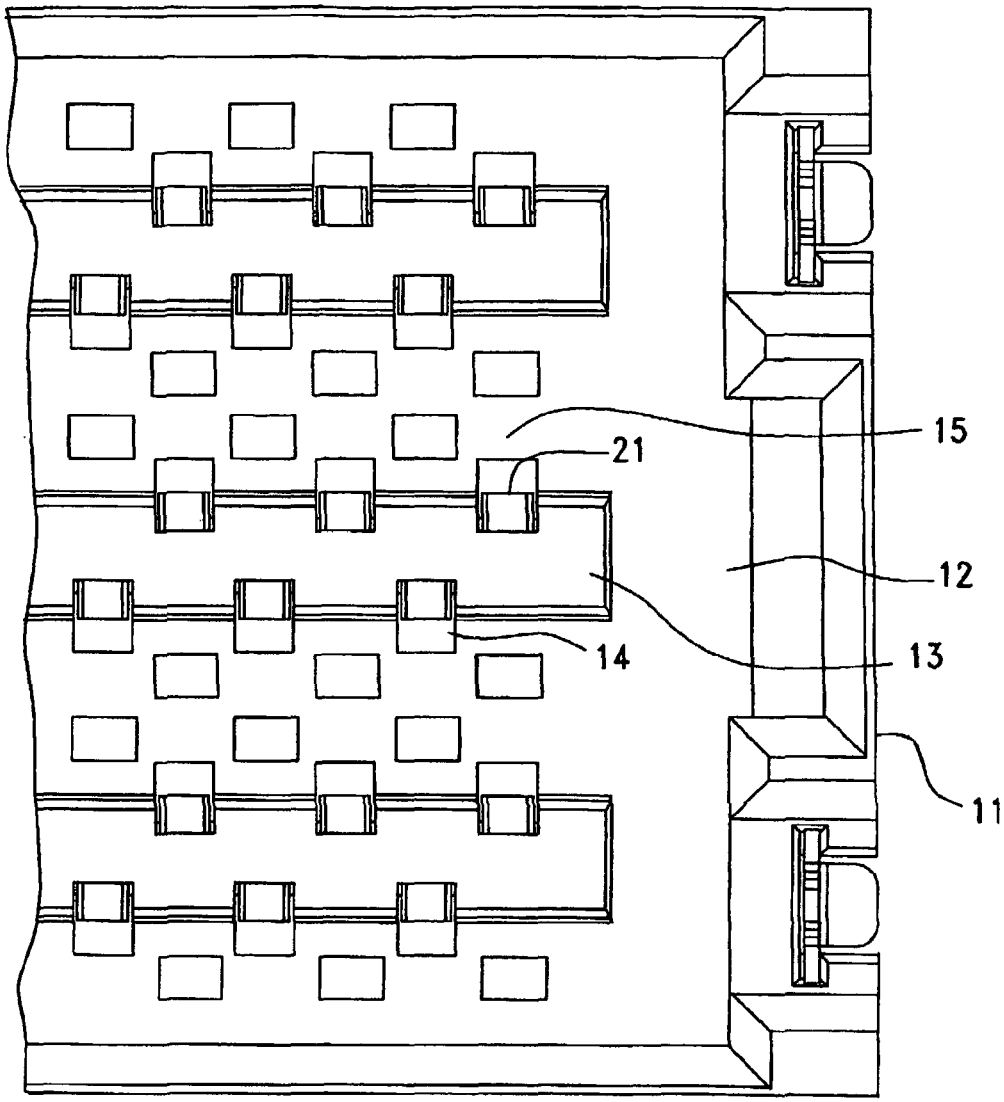
FIG. 3 is an enlarge a plain view snowing the main portion of the first connector according to the embodiment.

FIG. 1 is a perspective view of a first connector according to an embodiment of the present invention; FIG. 2 is an enlarged perspective view showing a main portion of the first connector according to the embodiment; and FIG. 3 is an enlarged plan view showing the main portion of the first connector according to the embodiment.

In these drawings, reference numeral 10 denotes a first connector, which is one of paired board-to-board connectors according to the present embodiment and which is a surface-mount-type connector to be mounted on a first circuit board 20 to be described later. The first connector 10 is inserted into a second connector 30, which is a counterpart connector and which will be described later. The second connector 30 is a surface-mount-type connector to be mounted on a second circuit board 40 to be described later. The board-to-board connectors according to the present embodiment include the first connector 10 and the second connector 30 and electrically connect a pair of circuit boards; i.e., the circuit boards 20 and 40. Although the circuit boards 20 and 40 are printed circuit boards, the circuit boards 20 and 40 can be of any type.

In the present embodiment, terms for expressing direction, such as up, down, left, right, front, and rear, are used for explaining the structure and action of respective portions of the board-to-board connectors; however, these terms represent respective directions for the case where the board-to-board connectors are used in an orientation shown in the drawings, and must be construed to represent corresponding different directions when the orientation of the board-to-board connectors is changed.

The first connector 10 includes a first housing 11 integrally formed from an insulative material such as a synthetic resin. As shown in FIGS. 1 to 3, the first housing 11 has a shape of a generally rectangular thick plate, and a generally rectangular concave portion 12 is formed on an upper surface of the first housing 11. The first connector 10 has a size of about 15 mm (length)×about 7 mm (width)×about 1.3 mm (thickness); however, the size can be changed freely. In the concave portion 12, a plurality of ridge portions 13 are formed integrally with the first housing 11. The ridge portions 13 project upward from the bottom surface of the concave portion 12 and extend along the longitudinal direction of the first housing 11. Thus, an elongated groove portion 15 extending along the longitudinal direction of the first housing 11 is formed on either side of each ridge portion 13. In the illustrated example, the number of the ridge portions 13 is three; however, the number is arbitrary insofar as the number is not less than 2. Although each of the ridge portions 13 has a width of about 0.8 mm, the width may be changed freely.

First-terminal accommodation cavities 14 for accommodating first terminals 21 are formed on each of opposite side walls of each ridge portion 13. For example, ten first-terminal accommodation cavities 14 are formed on each side wall of each ridge portion 13 at a pitch of about 1 mm. Therefore, ten first terminals 21, which are accommodated in the first-terminal accommodation cavities 14, are disposed on each side wall of each ridge portion 13 at a pitch of about 1 mm. The first terminals 21 are disposed in a staggered manner such that the first terminals 21 on one side wall are positionally shifted from those on the other side wall by half a pitch. That is, each of the first terminals 21 on one side wall of each ridge portion 13 is centrally located between the first terminals 21 on the other side wall thereof with respect to the longitudinal direction of the first housing 11.

As shown in FIG. 3, when the first connector 10 is viewed from the upper side, the first terminals 21 which constitute a pair of terminal rows are arranged such that a single first terminal 21 disposed on a first side wall of the corresponding ridge portion 13 and two corresponding first terminals 21 disposed on a second side wall of the ridge portion 13 form a first triplet in the form of an isosceles triangle wherein the single first terminal 21 is located at the apex between the two equal sides and the two first terminals 21 are located on the remaining apexes, and such that a single first terminal 21 disposed on the second side wall of the corresponding ridge portion 13 and two corresponding first terminals 21 disposed on the first side wall of the ridge portion 13 form a second triplet in the form of an isosceles triangle which has an orientation opposite that of the first triplet. The first and second triplets are alternately arranged along the longitudinal direction of the ridge portion 13. The ground conductor of a differential signal line is connected to one first terminal 21 of each triplet, which terminal is located at the apex between the two equal sides of the isosceles triangle, and the paired signal conductors of the differential signal line are connected to the remaining first terminals 21 of each triplet, whereby generation of crosstalk can be prevented.

The pitches and numbers of the first-terminal accommodation cavities 14 and the first terminals 2 can be changed freely. Since the numbers of the first-terminal accommodation cavities 14 and the first terminals 21 are considerably large, in FIGS. 1 to 3, only those located in the vicinity of the opposite longitudinal end portions of each ridge portion 13 are illustrated.

FIGS. 1 to 3 show only portions of the first terminals 21 which serve as contact portions 23, which will be described later. FIGS. 1 to 3 show only portions of the first-terminal accommodation cavities 14, which portions accommodate the contact portions 23. However, in actuality, each first-terminal accommodation cavity 14 is formed such that it penetrates the corresponding ridge portion 13 from its upper surface to the lower surface of the first housing 11, and is expanded in the interior of the ridge portion 13, etc., to a size sufficient to accommodate the entirety of the first terminal 21.

Next, the structure of the first terminal 21 will be described.

Figure 4:
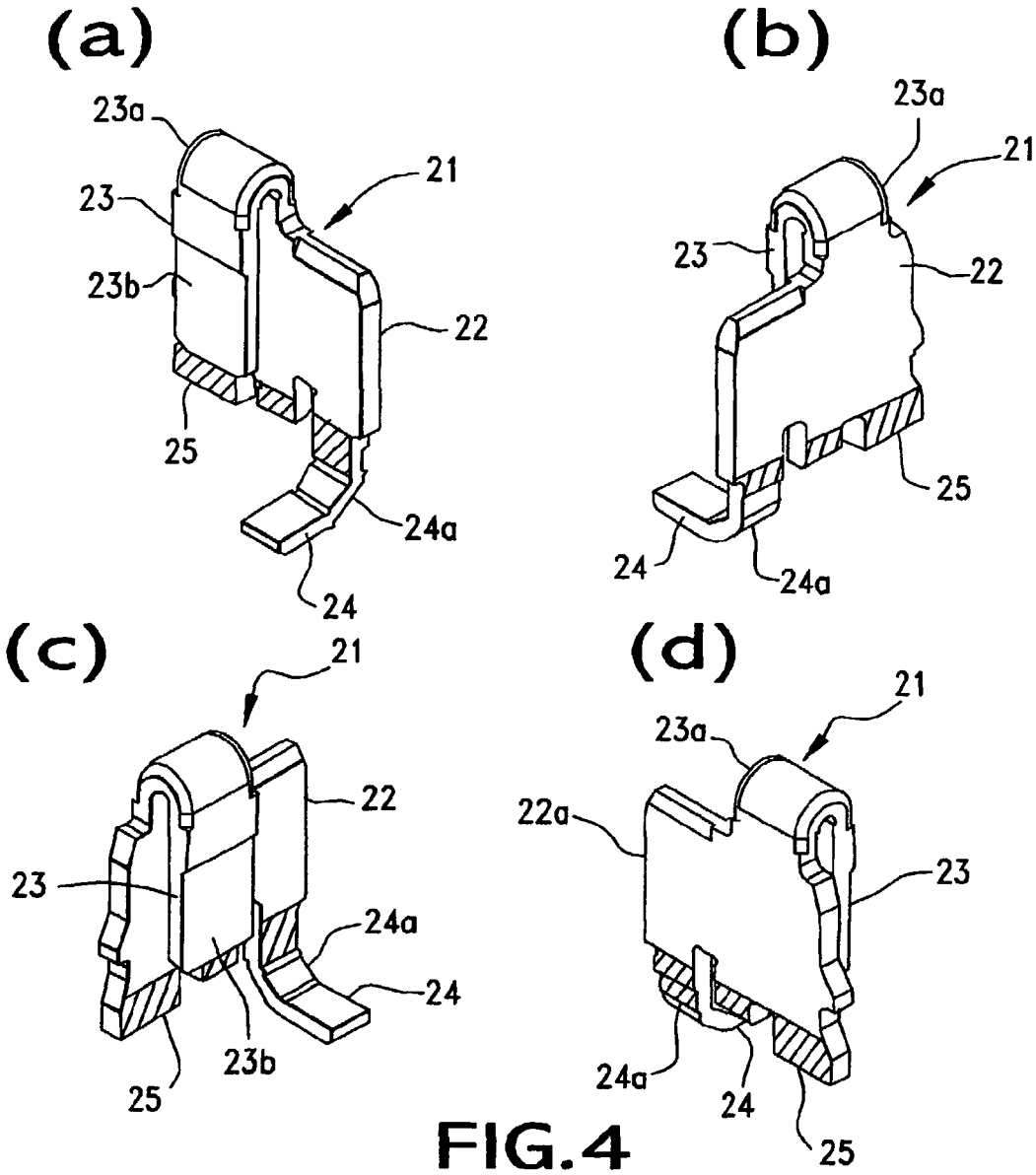
FIG. 4 is a perspective view of the first terminal according to the embodiment.
Figure 5:
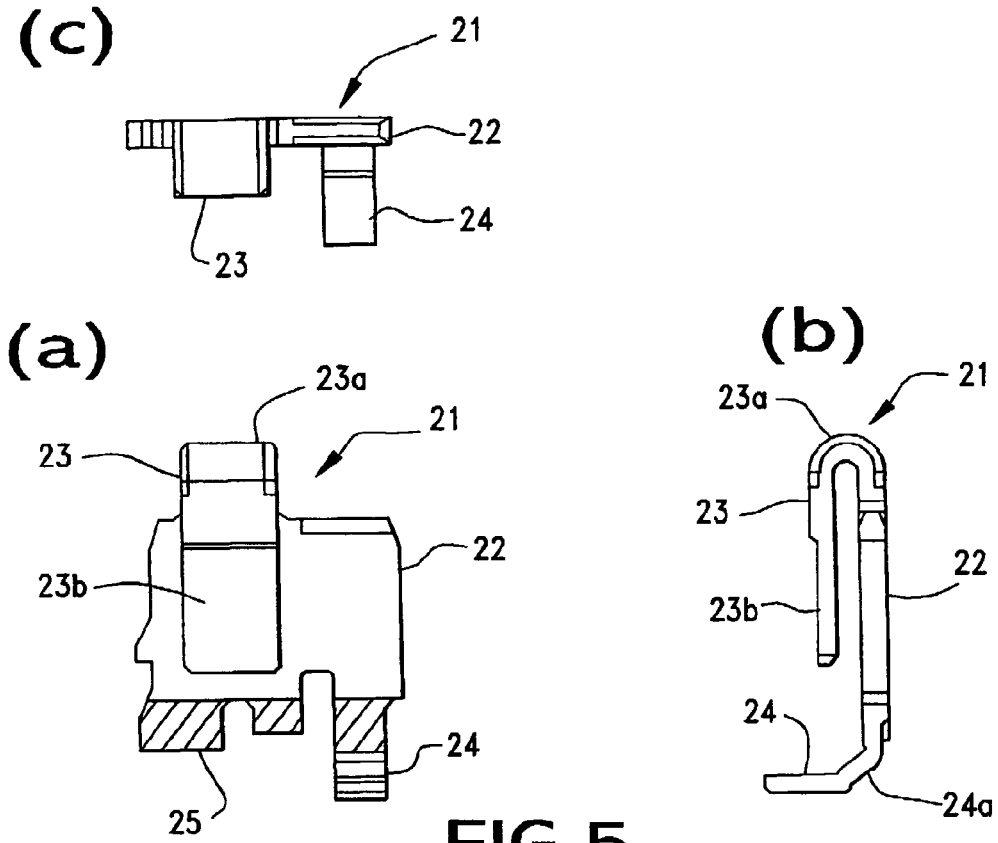
FIG. 5 is a view of the first terminal as viewed from three sides according to the embodiment.

FIG. 4 is a perspective view of the first terminal according to the embodiment; and FIG. 5 is a view of the first terminal as viewed from three sides according to the embodiment. Specifically, FIG. 4A is a front perspective view as viewed from the upper right; FIG. 4B is a rear perspective view as viewed from the upper left; FIG. 4C is a front perspective view as viewed from the upper left; FIG. 4D is a rear perspective view as viewed from the upper right; FIG. 5A is a front view; FIG. 5B is a side view; and FIG. 5C is a top view.

As shown in FIGS. 4 to 5, each first terminal 21 has a body portion 22, the contact portion 23, and a solder tail portion 24, and is integrally formed from an electrically conductive metal sheet through punching and forming (bending). The contact portion 23 is formed from an elongated plate-shaped portion extending from the upper end of the body portion 22, the plate-shaped portion being bent at a curved portion 23*a* by about 180°, so that the contact portion 23 is generally parallel to the body portion 22. A tip-end-side portion of the contact portion 23 is formed to serve as a contact flat portion 23*b*, whose front surface (left side surface in FIG. 5B) comes into contact with a contact portion 43 of a second terminal 41 (which will be described later) of the second connector 30. The contact portion 23, the curved portion 23*a*, the contact flat portion 23*b*, and the body portion 22 form a generally inverted-U-shaped side profile, as shown in FIG. 5B. Therefore, when the first connector 10 is mated with the second connector 30 and the front surface of the contact flat portion 23*b* is pushed toward the body portion 22 by the contact portion 43 of the second terminal 41, the contact flat portion 23*b* is pressed against the contact portion 43 of the second terminal 41, which is a counterpart terminal. Therefore, contact with the contact portion 43 of the second terminal 41 can be maintained reliably.

The solder tail portion 24 is formed from an elongated plate-shaped portion extending from the lower end of the body portion 22, the plate-shaped portion being bent at a bent portion 24*a* by about 90°, so that the solder tail portion 24 is generally perpendicular to the body portion 22. The solder tail portion 24, the bent portion 24*a*, and the body portion 22 form a generally L-shaped side profile, as shown in FIG. 5B. The solder tail portion 24 is soldered to a wiring land in a state in which the lower surface of the solder tail portion 24 faces the upper surface of the wiring land.

The first terminal 21 is formed such that the body portion 22 has a width of about 0.8 mm and a height of about 1 mm as measured from the lower end thereof to the upper surface of the curved portion 23*a*. However, the size of the first terminal 21 can be changed freely.

A laterally extending, strip-shaped solder barrier portion 25, serving as a barrier portion, is formed on the front surface (the left-hand surface in FIG. 5B) and rear surface (the right-hand surface in FIG. 5B) of the body portion 22. The solder barrier portion 25 is formed of, for example, a nickel (Ni) film formed through plating. However, film of any type may be used, insofar as solder hardly adheres to the formed film. Further, no limitation is imposed on the method of forming the solder barrier portion 25. The solder barrier portion 25 prevents so called "solder rising phenomenon" in which solder rises along the surface of the body portion 22 and adheres to the contact flat portion 23*b* when the solder tail portion 24 is soldered to a wiring land of the circuit board 20.

Further, in the first terminal 21, whereas the solder tail portion 24 extends from the lower end of the body portion 22, the contact portion 23 extends from the upper end of the body portion 22 and is bent by about 180°. Therefore, the distance between the solder tail portion 24 and the contact flat portion 23*b* is long, so that solder is less likely to rise along the surface of the body portion 22 and reach the contact flat portion 23*b*. Moreover, as shown in FIG. 5A, whereas the solder tail portion 24 extends from the vicinity of the right end of the body portion 22 as viewed from the front side of the body portion 22, the contact portion 23 extends from the vicinity of the left end of the body portion 22 as viewed from the front side of the body portion 22. Therefore, not only in the vertical direction, but also in the lateral direction, the distance between the solder tail portion 24 and the contact flat portion 23*b* of the first terminal 21 is long, so that solder is less likely to rise along the surface of the body portion 22 and reach the contact flat portion 23*b*. Thus, by virtue of its shape, the first terminal 21 can prevent the solder rising phenomenon.

Notably, gold (Au) film is preferably formed on the solder tail portion 24 through plating in order to improve adherence of solder to the solder tail portion 24. Further, gold (Au) film is preferably formed on at least the front surface of the contact flat portion 23*b* in order to reduce electrical contact resistance.

Next, the first terminals 21 in a state in which they are mounted to the first housing 11 will be described.

Figure 6:
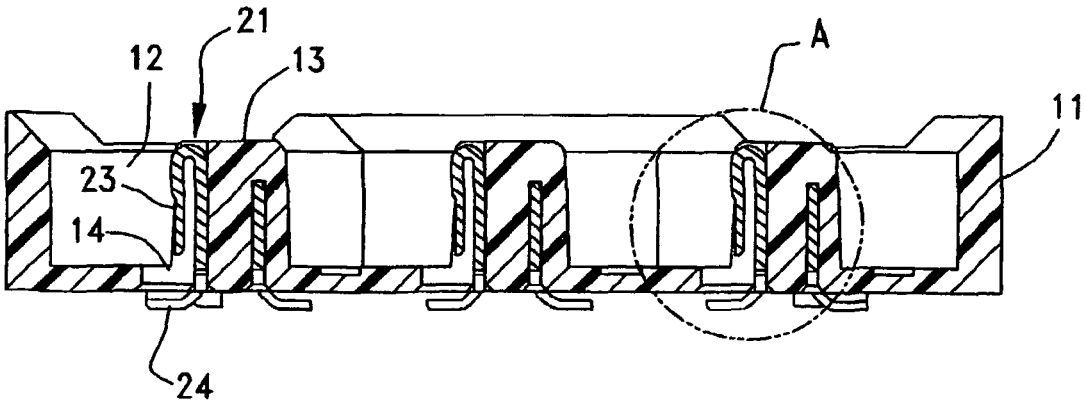
FIG. 6 is a lateral cross-sectional view of the first connector according to the embodiment.
Figure 7:
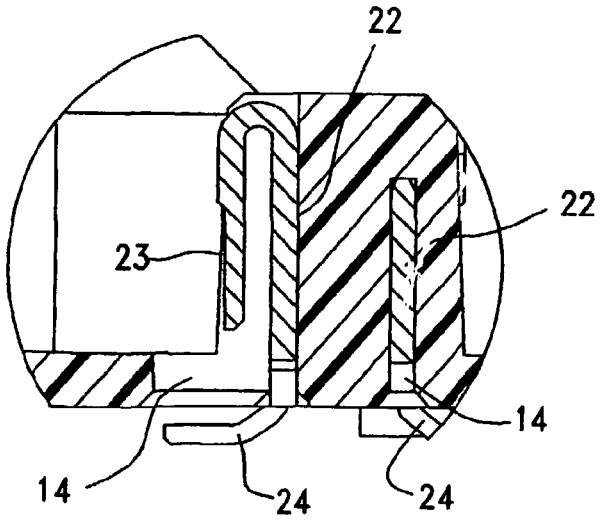
FIG. 7 is an enlarged lateral cross-sectional view showing a main portion of the first connector and an enlarged view of portion A of FIG. 6 according to the embodiment.

FIG. 6 is a lateral cross-sectional view of the first connector according to the embodiment; and FIG. 7 is an enlarged lateral cross-sectional view showing a main portion of the first connector and an enlarged view of portion A of FIG. 6 according to the embodiment.

As shown in FIGS. 6 and 7, each first-terminal accommodation cavity 14 is formed such that it penetrates the corresponding ridge portion 13 from its upper surface to the lower surface of the first housing 11. In the state in which the first terminal 21 is accommodated in the first-terminal accommodation cavity 14, the solder tail portion 24 projects downward (downward in FIG. 6) from the wall under the concave portion 12; i.e., from the lower surface of the first housing 11. Notably, the upper end of the first terminal 21; i.e., the upper end of the curved portion 23*a*, does not project from the upper surface of the ridge portion 13.

The solder tail portion 24 does not project to the outside of the first housing 11 with respect to the longitudinal direction and lateral direction of the first housing 11; i.e., with respect to directions parallel to the lower surface of the first housing 11 or the surface of the circuit board 20. Therefore, even when the first connector 10 is surface-mounted to the circuit board 20 by means of soldering the solder tail portion 24 to a corresponding wiring land of the circuit board 20, the solder tail portion 24 does not project to the outside of the first housing 11, whereby the mounting area can be reduced.

As shown in FIGS. 1 to 3 as well, a portion of each first-terminal accommodation cavity 14 corresponding to the contact portion 23 is opened to the upper surface and the corresponding side wall surface of the ridge portion 13. Meanwhile, a portion of the first-terminal accommodation cavity 14 corresponding to the body portion 22 assumes the form of a thin slit and extends within the ridge portion 13. The first terminal 21 is inserted and fitted into the first-terminal accommodation cavity 14 from the lower side of the first housing 11, so that the first terminal 21 is accommodated in the first-terminal accommodation cavity 14. At this time, the front surface and rear surface of the body portion 22 are nipped between opposite wall surfaces of the thin-slit-shaped portion of the first-terminal accommodation cavity 14, whereby the first terminal 21 is fixed. Further, a projection is formed at least one side edge (left side edge in FIG. 5A) of the body portion 22. Since the projection bites into the corresponding wall surface of the first-terminal accommodation cavity 14, the first terminal 21 is prevented from coming off the first-terminal accommodation cavity 14.

Next, the second connector 30 will be described.

Figure 8:
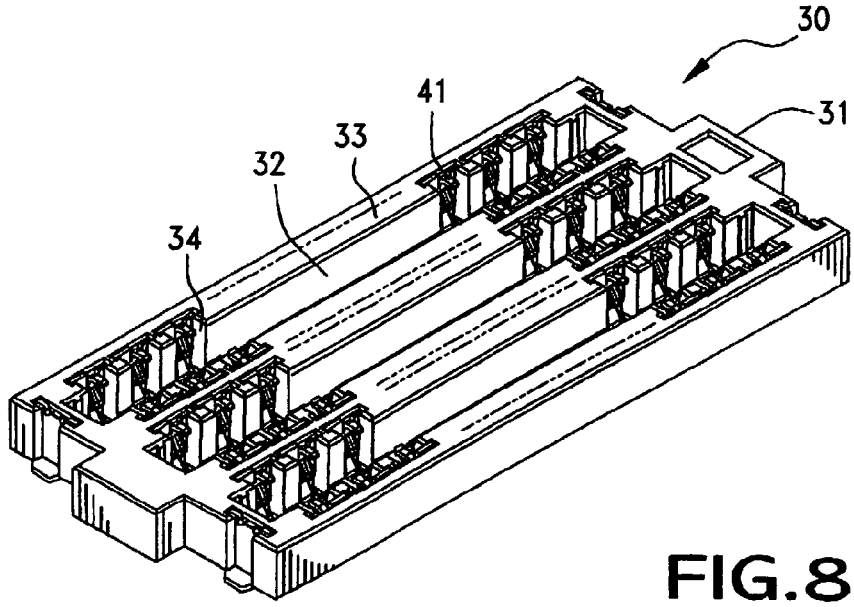
FIG. 8 is a perspective view of a second connector according to the embodiment.
Figure 9:
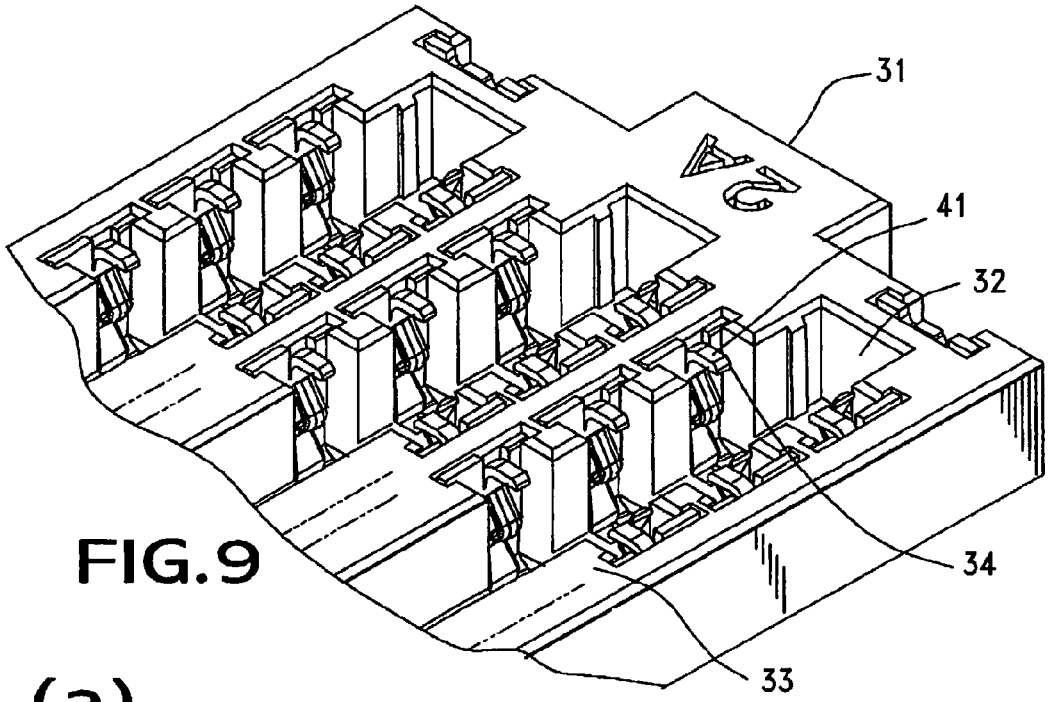
FIG. 9 is an enlarged perspective view showing a main portion of the second connector according to the embodiment.

FIG. 8 is a perspective view of the second connector according to the embodiment; FIG. 9 is an enlarged perspective view showing a main portion of the second connector according to the embodiment; and FIG. 10 is an enlarged plan view showing the main portion of the second connector according to the embodiment.

The second connector 30 includes a second housing 31 integrally formed from an insulative material such as a synthetic resin. As shown in FIGS. 8 to 10, the second housing 31 has a shape of a generally rectangular thick plate, and a generally rectangular upper surface. The second connector 30 has a size of about 14 mm (length)×about 6 mm (width)× about 1.1 mm (thickness); however, the size can be changed freely. A plurality of trench portions 32 are formed on the upper surface. The trench portions 32 extend along the longitudinal direction of the second housing 31. Thus, an elongated ridge portion 33 extending along the longitudinal direction of the second housing 31 is formed on each of opposite sides of each trench portion 32. In the illustrated example, the number of the trench portions 32 is three; however, the number is arbitrary, insofar as the number is not less than 2. Although each of the trench portions 32 has a width of about 0.8 mm, the width may be changed freely.

Second-terminal accommodation cavities 34 for accommodating second terminals 41 are formed on each of opposite side walls of each trench portion 32. For example, ten second-terminal accommodation cavities 34 are formed on each side wall of each trench portion 32 at a pitch of about 1 mm.

Therefore, ten second terminals 41, which are accommodated in the second-terminal accommodation cavities 34, are disposed on each side wall of each trench portion 32 at a pitch of about 1 mm. The second terminals 41 are disposed in a staggered manner such that the second terminals 41 on one side wall are positionally shifted from those on the other side wall by half a pitch. That is, each of the second terminals 41 on one side wall of each trench portion 32 is centrally located between the second terminals 41 on the other side wall thereof with respect to the longitudinal direction of the second housing 31.

As shown in FIG. 10, when the second connector 30 is viewed from the upper side, the second terminals 41 which constitute a pair of terminal rows are arranged such that a single second terminal 41 disposed on a first side wall of the corresponding trench portion 32 and two corresponding second terminal 41 disposed on a second side wall of the trench portion 32 form a first triplet in the form of an isosceles triangle wherein the single second terminal 41 is located at the apex between the two equal sides and the two second terminals 41 are located on the remaining apexes, and such that a single second terminal 41 disposed on the second side wall of the corresponding trench portion 32 and two corresponding second terminal 41 disposed on the first side wall of the trench portion 32 form a second triplet in the form of an isosceles triangle which has an orientation opposite that of the first triplet. The first and second triplets are alternately arranged along the longitudinal direction of the trench portion 32. The ground conductor of a differential signal line is connected to one second terminal 41 of each triplet, which terminal is located at the apex between the two equal sides of the isosceles triangle, and the paired signal conductors of the differential signal line are connected to the remaining second terminals 41 of each triplet, whereby generation of crosstalk can be prevented.

The pitches and numbers of the second-terminal accommodation cavities 34 and the second terminals 41 can be changed freely. Since the numbers of the second-terminal accommodation cavities 34 and the second terminals 41 are considerably large, in FIGS. 8 to 10, only those located in the vicinity of the opposite longitudinal end portions of each trench portion 32 are illustrated.

FIGS. 8 to 10 show only portions of each second terminal 41 which respectively serve as a contact portion 43 and a lean preventing portion or locating tab 45, which will be described later. FIGS. 8 to 10 show only portions of each second-terminal accommodation cavity 34, which portions accommodate the contact portion 43 and the lean preventing portion 45, respectively. However, in actuality, each second-terminal accommodation cavity 34 is formed such that it penetrates the corresponding ridge portion 33 from its upper surface to the lower surface of the second housing 31, and has a size sufficient to accommodate the entirety of the second terminal 41.

Next, the structure of the second terminal 41 will be described.

Figure 11:
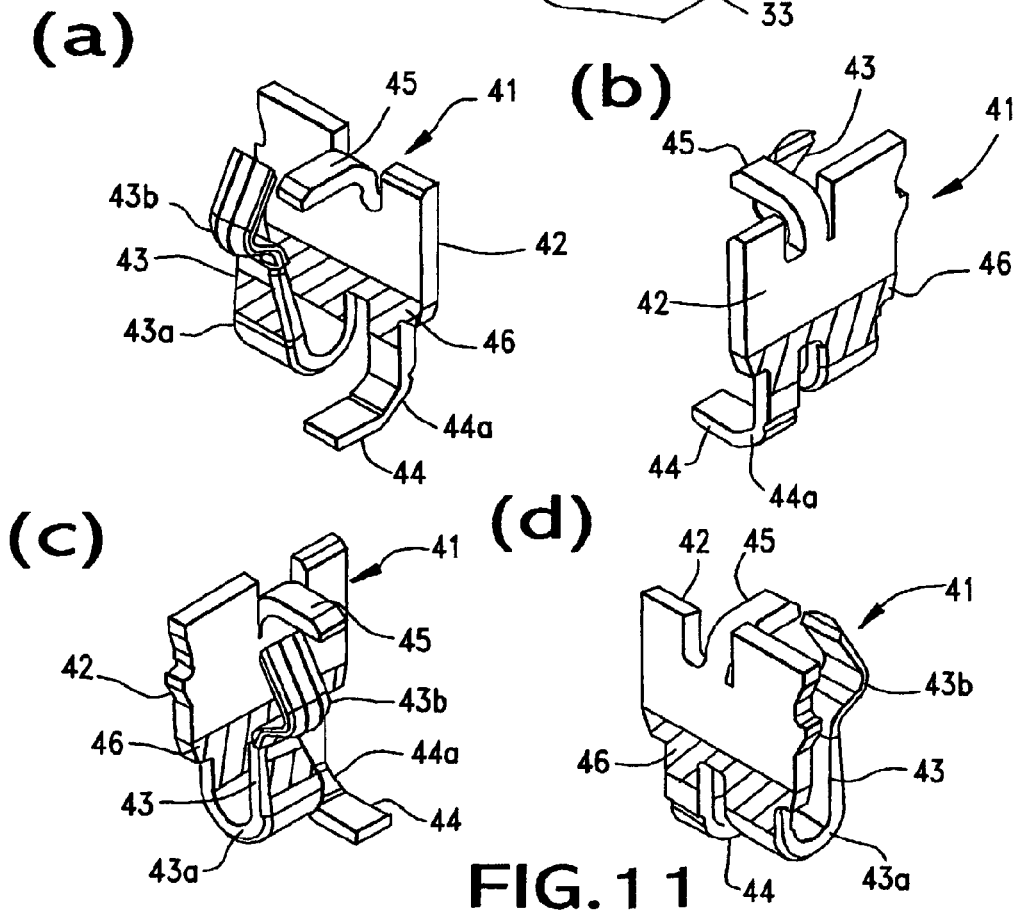
FIG. 11 is a perspective view of a second terminal according to the embodiment.
Figure 12:
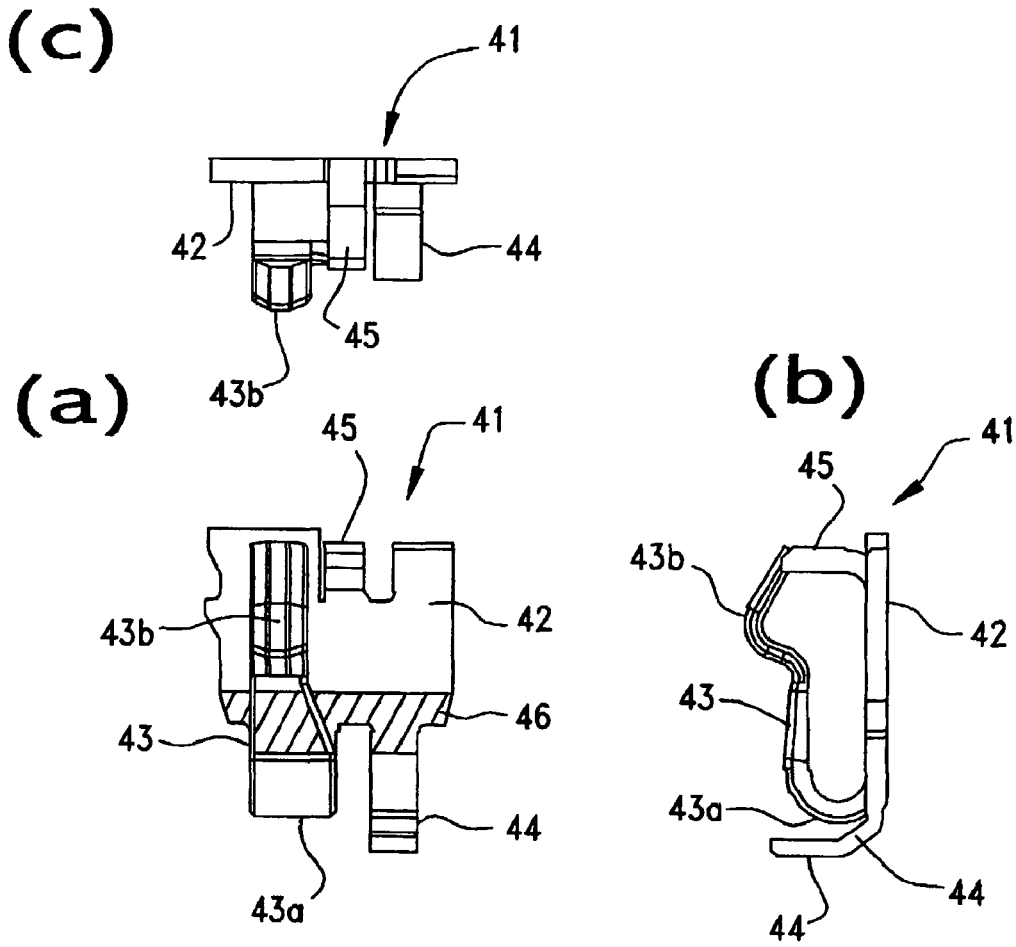
FIG. 12 is a view of the second terminal as viewed from three sides according to the embodiment.

FIG. 11 is a perspective view of the second terminal according to the embodiment; and FIG. 12 is a view of the second terminal as viewed from three sides according to the embodiment. Specifically, FIG. 11A is a front perspective view as viewed from the upper right; FIG. 11B is a rear perspective view as viewed from the upper left; FIG. 11C is a front perspective view as viewed from the upper left; FIG. 11D is a rear perspective view as viewed from the upper right; FIG. 12A is a front view; FIG. 12B is a side view; and FIG. 12C is a top view.

As shown in FIGS. 11 and 12, each second terminal 41 has a body portion 42, the contact portion 43, a solder tail portion 44, and the lean preventing portion or locating portion 45, and is integrally formed from an electrically conductive metal sheet through punching and forming (bending). The contact portion 43 is formed from an elongated plate-shaped portion extending from the lower end of the body portion 42, the plate-shaped portion being bent at a curved portion 43*a* by about 180°, so that the contact portion 43 is generally parallel to the body portion 42. A tip-end-side portion of the contact portion 43 is bent in a generally S-like shape to thereby form a contact convex surface portion 43*b*, which comes into contact with the front surface of the contact portion 23 of the first terminal 21, which is a counterpart terminal. The contact portion 43, the curved portion 43*a*, and the body portion 42 form a generally U-shaped side profile, as shown in FIG. 12B. Further, the contact convex surface portion 43*b* has a generally S-shaped side profile. That is, a lower portion of the contact portion 43 has a U-shaped side profile, and an upper portion of the contact portion 43 has an S-shaped side profile. The contact portion 43 has a spring property realized mainly by means of elastic deformation of the curved portion 43*a* and the contact convex surface portion 43*b*.

Therefore, when the second connector 30 is mated with the first connector 10 and the front surface (left-side surface in FIG. 12B) of the contact convex surface portion 43*b* is pushed toward the body portion 42 by the contact portion 23 of the first terminal 21 of the first connector 10, the contact convex surface portion 43*b* is caused to react by means of the spring property of the contact portion 43, so that the contact convex surface portion 43*b* is pressed against the contact portion 23 of the first terminal 21, which is a counterpart terminal. Therefore, contact with the contact portion 23 of the second terminal 21 can be maintained reliably.

The solder tail portion 44 is formed from an elongated plate-shaped portion extending from the lower end of the body portion 42, the plate-shaped portion being bent at a bent portion 44*a* by about 90°, so that the solder tail portion 44 is generally perpendicular to the body portion or retaining base 42. The solder tail portion 44, the bent portion 44*a*, and the body portion 42 form a generally L-shaped side profile, as shown in FIG. 12B. The lower surface of the solder tail portion 44 is soldered to a wiring land formed on the surface of the circuit board 40, whereby the second connector 30 is mounted to the circuit board 40.

The second terminal 41 is formed such that the body portion 42 has a width of about 0.8 mm and a height of about 1 mm as measured from the upper end thereof to the lower surface of the curved portion 43*a*. However, the size of the second terminal 41 can be changed freely.

A laterally extending, strip-shaped solder barrier portion 46, serving as a barrier portion, is formed on the front surface (the left-hand surface in FIG. 12B) and rear surface (the right-hand surface in FIG. 12B) of the body portion 42. The solder barrier portion 46 is a nickel (Ni) film formed through plating. However, film of any type may be used, insofar as solder hardly adheres to the formed film. Further, no limitation is imposed on the method of forming the solder barrier portion 46. The solder barrier portion 46 prevents so called "solder rising phenomenon" in which solder rises along the surface of the body portion 42 and adheres to the contact convex surface portion 43*b* when the solder tail portion 44 is soldered to a wiring land of the circuit board 40.

Further, in the second terminal 41, as shown in FIG. 12A, whereas the solder tail portion 44 extends from the vicinity of the right end of the body portion 42 as viewed from the front side of the body portion 42, the contact portion 43 extends from the vicinity of the left end of the body portion 42 as viewed from the front side of the body portion 42. Therefore, the lateral distance between the solder tail portion 44 and the contact convex surface portion 43*b* is long, so that solder is less likely to rise along the surface of the body portion 42 and reach the contact convex surface portion 43*b*. Moreover, as shown in FIG. 12B, the contact convex surface portion 43*b* is separated away from the front surface of the body portion 42. Therefore, not only in the lateral direction, but also in the front-rear direction (lateral direction in FIG. 12B), the distance between the solder tail portion 44 and the contact convex surface portion 43*b* is long, so that solder is less likely to rise along the surface of the body portion 42 and reach the contact convex surface portion 43*b*. Thus, by virtue of its shape, the second terminal 41 can prevent the solder rising phenomenon.

Notably, gold film is preferably formed on the solder tail portion 44 through plating in order to improve adherence of solder to the solder tail portion 44. Further, gold film is preferably formed on at least the front surface of the contact convex surface portion 43*b* in order to lower electrical contact resistance.

The above-mentioned lean preventing portion 45 is extends from the vicinity of the upper end of the body portion 42 such that the lean preventing portion 45 projects forward (leftward in FIG. 12B) to a point near the side edge (right-hand edge in FIG. 12A) of the contact portion 43. As shown in FIG. 12B, the tip end of the lean preventing portion 45 is located at substantially the same position as the tip end of the contact portion 43 with respect to the front-rear direction. By virtue of this configuration, when the contact portion 43 receives a force in the rightward direction in FIG. 12A, the contact portion 43 comes into contact with and is supported by the lean preventing portion 45. Therefore, the contact portion 43 does not lean toward the right in FIG. 12A. As shown in FIGS. 9 and 10, in a state in which the second terminal 41 is accommodated in the second-terminal accommodation cavity 34, one side wall of the second-terminal accommodation cavity 34 is located near the side edge (left-hand edge in FIG. 12A) of the contact portion 43 opposite the lean preventing portion 45. Therefore, when the contact portion 43 receives a force in the leftward direction in FIG. 12A, the contact portion 43 comes into contact with and is supported by the side wall of the second-terminal accommodation cavity 34. Therefore, the contact portion 43 does not lean toward the left in FIG. 12A. In the present embodiment, the curved portion 43*a* and the contact convex surface portion 43*b* of the second terminal 41 elastically deform, and the curved portion 23*a* of the first terminal 21 does not elastically deform. However, this relation may be reversed. Further, the first and second terminals 21 and 41 may be configured such that both the curved portion 23*a* of the first terminal 21 and the curved portion 43*a* of the second terminal 41 elastically deform so as to establish electrical contact between the contact portion 23 of the first terminal 21 and the contact portion 43 of the second terminal 41.

Next, the second terminals 41 in a state in which they are mounted to the second housing 31 will be described.

Figure 14:
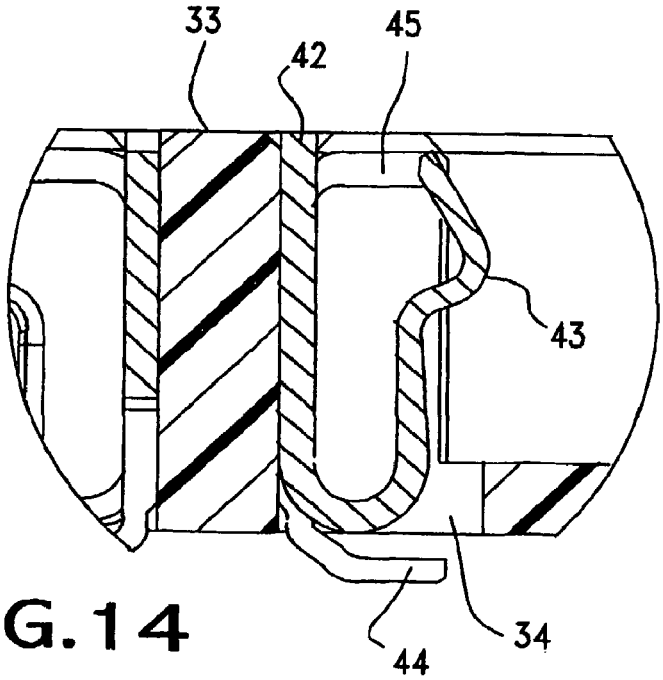
FIG. 14 is an enlarged lateral cross-sectional view showing a main portion of the second connector and an enlarged view of portion B of FIG. 13 according to the embodiment.

FIG. 13 is a lateral cross-sectional view of the second connector according to the embodiment; and FIG. 14 is an enlarged lateral cross-sectional view showing a main portion of the second connector and an enlarged view of portion B of FIG. 13 according to the embodiment.

As shown in FIGS. 13 and 14, each second-terminal accommodation cavity 34 is formed such that it penetrates the corresponding ridge portion 33 from its upper surface to the lower surface of the second housing 31. In the state in which the second terminal 41 is accommodated in the second-terminal accommodation cavity 34, the solder tail portion 44 projects downward (downward in FIG. 13) from the wall under the trench portion 32; i.e., from the lower surface of the second housing 31. Notably, the upper end of the second terminal 41 does not project from the upper surface of the ridge portion 33.

The solder tail portion 44 does not project to the outside of the second housing 31 with respect to the longitudinal direction and lateral direction of the second housing 31; i.e., with respect to directions parallel to the lower surface of the second housing 31 or the surface of the circuit board 40. Therefore, even when the second connector 30 is surface-mounted to the circuit board 40 by means of soldering the solder tail portion 44 to a corresponding wiring land of the circuit board 40, the solder tail portion 44 does not project to the outside of the second housing 31, whereby the mounting area can be reduced.

As shown in FIGS. 8 to 10 as well, a portion of each second-terminal accommodation cavity 34 corresponding to the contact portion 43 is opened to the upper surface of the ridge portion 33 and the corresponding side wall surface of the trench portion 32. Meanwhile, at that portion, each second-terminal accommodation cavity 34 has a width (with respect to the lateral direction of the second terminal 41) corresponding to the distance between the left-hand edge of the contact portion 43 and the right-hand edge of the solder tail portion 44 in FIG. 12A. Further, at the opposite lateral edges of the body portion 42, corresponding portions of the second-terminal accommodation cavity 34 each assume the form of a thin slit and extends within the ridge portion 33. The second terminal 41 is inserted and fitted into the second-terminal accommodation cavity 34 from the upper side of the second housing 31, so that the second terminal 41 is accommodated in the second-terminal accommodation cavity 34. At this time, at the opposite lateral edges of the body portion 42, the front surface and rear surface of the body portion 42 are nipped between opposite wall surfaces of the thin-slit-shaped portion of the second-terminal accommodation cavity 34, whereby the second terminal 41 is fixed. Further, a projection is formed at least one side edge (left side edge in FIG. 12A) of the body portion 42. Since the projection bites into the corresponding wall surface of the second-terminal accommodation cavity 34, the second terminal 41 is prevented from coming off the second-terminal accommodation cavity 34.

Next, action of mating the first connector 10 with the second connector 30 will be described.

Figure 15:
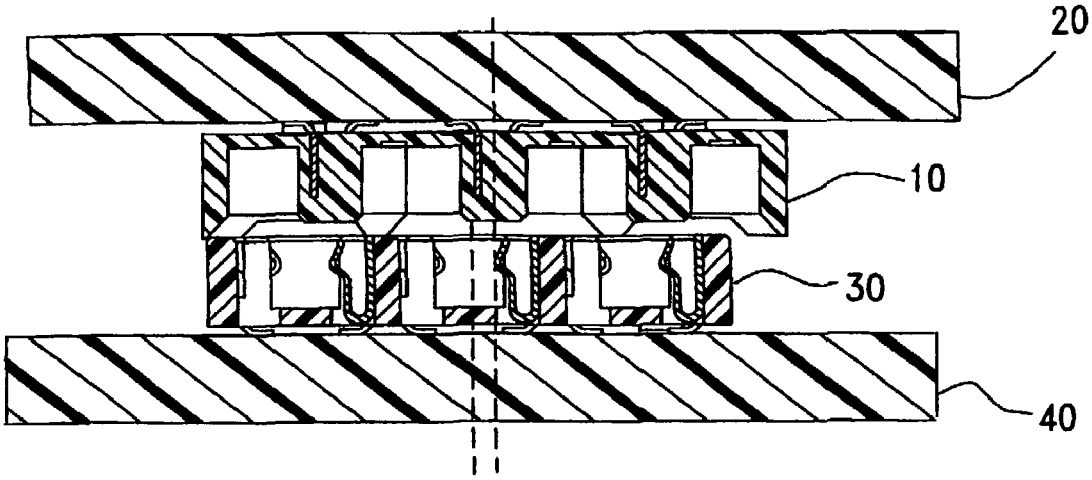
FIG. 15 is a sectional view showing a state before the first and second connectors of the embodiment are mated together.
Figure 16:
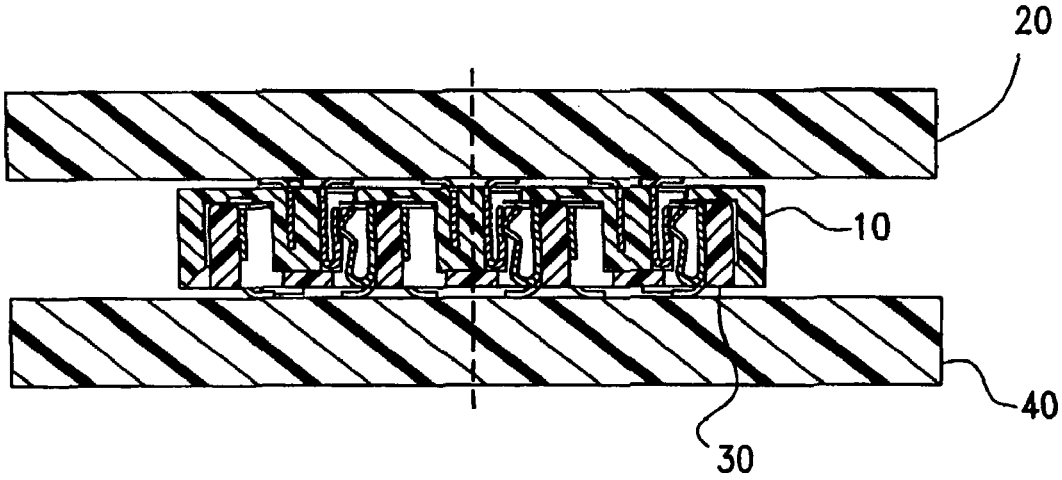
FIG. 16 is a sectional view showing a state after the first and second connectors of the embodiment are mated together.

FIG. 15 is a sectional view showing a state before the first and second connectors of the embodiment are mated together; and FIG. 16 is a sectional view showing a state after the first and second connectors of the embodiment are mated together.

As shown in FIGS. 15 and 16, the first connector 10 has already been surface-mounted to the circuit board 20 through soldering of the solder tail portions 24 of the first terminals 21 to the corresponding wiring lands of the circuit board 20. Similarly, the second connector 30 has already been surface-mounted to the circuit board 40 through soldering of the solder tail portions 44 of the second terminals 41 to the corresponding wiring lands of the circuit board 40.

As shown in FIG. 15, the circuit board 20 is placed on the circuit board 40 such that the upper surface (lower surface in FIG. 15) of the first connector 10 faces the upper surface of the second connector 30. In this state, the upper surface of the first connector 10 and the upper surface of the second connector 30 are parallel to each other, and the circuit board 20 and the circuit board 40 are parallel to each other.

Subsequently, the first connector 10 or the second connector 30 is moved to the counterpart connector and is mated therewith as shown in FIG. 16. Since the peripheral wall of the first housing 11 of the first connector 10 is tapered at the inner edge thereof, even when the first connector 10 is misaligned with the second connector 30, the first connector 10 can be smoothly mated with the second connector 30. In a state in which the first connector 10 is mated with the second connector 30, the ridge portions 13 of the first connector 10 are received within the corresponding trench portions 32 of the second connector 30, and the contact flat portion 23*b* of each first terminal 21 comes into contact with the contact convex surface portion 43*b* of the corresponding second terminal 41, whereby electrical connection is established between each first terminal 21 and the corresponding second terminal 41.

As described above, in the present embodiment, the first connector 10 and the second connector 30, which serve as a pair of board-to-board connectors, include the integrally formed first and second housings 11 and 31, respectively; and the first terminals 21 and the second terminals 41 are attached to the first and second housing 11 and 31, respectively, such that a plurality of (e.g., three) pairs of terminal rows are formed on each housing. Therefore, the first connector 10 and the second connector 30 can support a large number of (e.g., 60) first terminals 21 and second terminals 41, even though they are small in size. Moreover, by mating the first connector 10 and the second connector 30 together, reliable connection can be easily established between a large number of signal traces formed on the circuit board 20 to which the first connector 10 is mounted and a large number of signal traces formed on the circuit board 40 to which the second connector 30 is mounted. Since rows of the first terminals 21 and rows of the second terminals 41 are respectively disposed to form pairs, even in the case where the above-mentioned signal traces include traces for differential signals, the signal traces can be connected to the corresponding terminals such that no crosstalk is generated.

The first and second terminals 21 and 41 have the surface-mount-type solder tail portions 24 and 44 which do not project to the outside of the first housing 11 and the outside of the second housing 31, respectively. That is, in a state in which the first connector 10 is mounted to the circuit board 20, the solder tail portions 24 are located between the first connector 10 and the circuit board 20 and have no portion which projects outward from the outer circumference of the first connector 10. Similarly, in a state in which the second connector 30 is mounted to the circuit board 40, the solder tail portions 44 are located between the second connector 30 and the circuit board 40 and have no portion which projects outward from the outer circumference of the second connector 30. Therefore, areas on the circuit boards 20 and 40 required to mount the first and second connectors 10 and 30, respectively; that is, their mount areas, can be reduced, whereby the circuit boards 20 and 40 can be densified.

The first and second terminals 21 and 41 have the solder barrier portions 25 and 46, respectively, which are formed of film to which solder hardly adheres. Therefore, it becomes possible to prevent a so-called solder rising phenomenon which would otherwise occur when the solder tail portions 24 and 44 are soldered to wiring lands of the circuit boards 20 and 40. Moreover, since the first and second terminals 21 and 41 are each shaped such that a large distance is provided between the solder tail portion and the contact portion, the solder rising phenomenon can be prevented more reliably.

Moreover, the second terminals 41 each have the lean preventing portion 45. Therefore, even if the opening of the second-terminal accommodation cavity 34 is wide, the contact portion 43 does not lean laterally, because the contact portion 43 is supported by the lean preventing portion 45. By virtue of this configuration, even when the contact portion 43 of each second terminal 41 comes into contact with the contact portion 23 of the corresponding first terminal 21 and receives a lateral force as a result of mating of the first connector 10 with the second connector 30, the contact portion 43 does not lean in the lateral direction. Therefore, the contact portion 23 of each first terminal 21 and the contact portion 43 of the corresponding second terminal 41 come into contact without fail, whereby electrical continuity is established between each first terminal 21 and the corresponding second terminal 41.

Since the first terminals 21 and the second terminals 41 are arranged in a grid pattern, the degree of freedom in allocation of wire conductors to the first terminals 21 and the second terminals 41; i.e., the degree of freedom of pin assignment, is high. Therefore, the arrangement of the first and second terminals 21 and 41 assigned to signal conductors and the arrangement of the first and second terminals 21 and 41 assigned to ground conductors can be determined freely. For example, when a ground conductor is connected to at least terminals 21 or 41 located at the outermost positions in the grid pattern so as to ground them to the circuit board 20 or 40, an effect similar to that attained through provision of an electromagnetic shield can be attained. Further, when a ground conductor is connected to terminals 21 or 41 located at positions surrounding one or more terminals 21 or 41 to which a signal conductor(s) is connected, whereby the former terminals are grounded to the circuit board 20 or 40, a function similar to that of a coaxial connector to which a coaxial cable is connected can be attained. The present invention is not limited to the above-described embodiment. Numerous modifications and variations of the present invention are possible in light of the spirit of the present invention, and they are not excluded from the scope of the present invention.

What is claimed is:

1. A board-to-board connector comprising:

an integrally formed housing; and a plurality of terminals attached to the housing and forming a plurality of pairs of terminal rows, each terminal being arranged generally in a grid pattern and having a surface-mount-type solder tail portion;

wherein the solder tail portion does not project to the outside of the housing, and at least the terminals located at the outermost positions in the grid pattern are electrically grounded to a board.

2. A board-to-board connector according to claim 1, wherein each of the terminals has a contact portion which comes into contact with a counterpart terminal, and a barrier portion formed between the solder tail portion and the contact portion and formed of a film to which solder hardly adheres.

3. A board-to-board connector according to claim 1, wherein at least some of the terminals have a lean-preventing portion formed on at least one side of the contact portion to be located near the contact portion.

4. A connector mountable to a printed circuit board, comprising:

a non-conductive housing with a plurality of slots, each slot defined by opposed first and second end walls with grooves in each end wall;

a plurality of terminals each terminal with a longitudinal axis, a retaining base, a solder tail portion, a resilient contact arm and an alignment tab;

the retaining base having opposed edges, each edge adapted to fit into a respective groove in the end walls holding each terminal to the non-conductive housing;

the solder tail portion, extending from the retaining base, adjacent to the first end wall of the slot, adapted for soldering to the printed circuit board;

the resilient contact arm having opposed first and second sides extending from the retaining base, the first side of the arm located adjacent the second end wall of the slot, the contact arm adapted to engage with a terminal from a mating connector, so that the resilient contact arm and the solder tail portion are offset from each other in a direction parallel to the longitudinal axis of the terminal; and a locating tab stamped from the retaining base with one end adjacent the second side of the resilient contact arm so that the second side of the resilient contact arm will engage the one edge of the locating tab if a side force is placed on the resilient contact arm causing it to move away from the first side wall of the slot.

5. A board-to-board connector comprising:

an integrally formed housing;

a plurality of terminals attached to the housing and forming a plurality of pairs of terminal rows, each terminal being arranged generally in a grid pattern and having a surface-mount-type solder tail portion; and a signal trace is connected to at least one terminal;

wherein the solder tail portion does not project to the outside of the housing, and terminals located at positions surrounding the one terminal are electrically grounded to a board.

6. A board-to-board connector according to claim 5, wherein each of the terminals has a contact portion which comes into contact with a counterpart terminal, and a barrier portion formed between the solder tail portion and the contact portion and formed of a film to which solder hardly adheres.

7. A board-to-board connector according to claim 5, wherein at least some of the terminals have a lean-preventing portion formed on at least one side of the contact portion to be located near the contact portion.

* * * * *